US009799268B2

(12) United States Patent
Gai et al.

(10) Patent No.: US 9,799,268 B2
(45) Date of Patent: Oct. 24, 2017

(54) ACTIVE MATRIX ORGANIC LIGHT-EMITTING DIODE (AMOLED) PIXEL DRIVING CIRCUIT, ARRAY SUBSTRATE AND DISPLAY APPARATUS

(71) Applicant: BOE TECHNOLOGY GROUP CO., LTD., Beijing (CN)

(72) Inventors: Cuili Gai, Beijing (CN); Danna Song, Beijing (CN); Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 4 days.

(21) Appl. No.: 14/342,262

(22) PCT Filed: Jun. 19, 2013

(86) PCT No.: PCT/CN2013/077496

§ 371 (c)(1),
(2) Date: Feb. 28, 2014

(87) PCT Pub. No.: WO2014/172977

PCT Pub. Date: Oct. 30, 2014

(65) Prior Publication Data

US 2015/0161944 A1 Jun. 11, 2015

(30) Foreign Application Priority Data

Apr. 24, 2013 (CN) ..... 2013 1 0145677

(51) Int. Cl.
*G09G 3/30* (2006.01)
*G09G 3/3258* (2016.01)
(Continued)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC ..... G09G 3/3233; G09G 3/3258
(Continued)

(56) References Cited

U.S. PATENT DOCUMENTS

2005/0110730 A1* 5/2005 Kim et al. ..... 345/82
2006/0043366 A1* 3/2006 Ha et al. ..... 257/59
(Continued)

FOREIGN PATENT DOCUMENTS

CN 101373578 A 2/2009
CN 102456318 A 5/2012
(Continued)

OTHER PUBLICATIONS

Third Chinese Office Action Appln, No. 201310145677.X; Dated Dec. 10, 2014.
(Continued)

*Primary Examiner* — Adam J Snyder
(74) *Attorney, Agent, or Firm* — Ladas & Parry LLP

(57) ABSTRACT

A pixel driving circuit, an array substrate and a display apparatus, the pixel driving circuit includes a driving transistor and an organic light-emitting diode, it further comprises: a charging compensation module, for receiving a data voltage signal, charging the driving transistor and compensating for a threshold voltage of the driving transistor, under the control of a scan voltage signal; and a light-emitting control module, for receiving a reference voltage and a power supply voltage, and controlling the organic light-emitting diode to emit lights, under the control of a light-emitting control signal. The problem of the non-uniformity of threshold voltages is eliminated by compensating for the threshold voltages of driving transistors thereby enhancing the display effect of the display apparatus.

8 Claims, 4 Drawing Sheets

(51) Int. Cl.
*G09G 3/3233* (2016.01)
*G09G 3/10* (2006.01)

(52) U.S. Cl.
CPC ..... *G09G 2300/0861* (2013.01); *G09G 2320/045* (2013.01)

(58) Field of Classification Search
USPC ..... 345/76; 315/169.3
See application file for complete search history.

(56) References Cited

U.S. PATENT DOCUMENTS

| | | | | |
|---|---|---|---|---|
| 2006/0221009 | A1* | 10/2006 | Miwa | G09G 3/325 345/76 |
| 2007/0040772 | A1* | 2/2007 | Kim | 345/76 |
| 2007/0103406 | A1* | 5/2007 | Kim | 345/76 |
| 2007/0124633 | A1* | 5/2007 | Kim | 714/726 |
| 2009/0051628 | A1 | 2/2009 | Kwon | |
| 2009/0167648 | A1* | 7/2009 | Jeon et al. | 345/76 |
| 2009/0206770 | A1* | 8/2009 | Hong | G09G 3/3233 315/291 |
| 2009/0207105 | A1* | 8/2009 | Hwang | G09G 3/3233 345/76 |
| 2011/0115764 | A1* | 5/2011 | Chung | 345/76 |
| 2011/0115772 | A1* | 5/2011 | Chung | 345/76 |
| 2012/0098877 | A1 | 4/2012 | Taro et al. | |
| 2013/0050161 | A1* | 2/2013 | Park et al. | 345/76 |

FOREIGN PATENT DOCUMENTS

| | | |
|---|---|---|
| CN | 102966952 A | 3/2013 |
| CN | 203179476 U | 9/2013 |

OTHER PUBLICATIONS

International Search Report Issued Jan. 30, 2014; Appln. No. PCT/CN2013/077496.
First Chinese Office Action Issued Feb. 26, 2014; Appln. No. 20131014577.X.
Second Chinese Office Action Issued Jul. 9, 2014; Apnln. No. 201310145677.X.
Chinese Rejection Decision dated May 4, 2015; Appln. No. 201310145677.X.
International Preliminary Report on Patentability issued Oct. 27, 2015, PCT/CN2013/077496.

* cited by examiner

ACTIVE MATRIX ORGANIC LIGHT-EMITTING DIODE (AMOLED) PIXEL DRIVING CIRCUIT, ARRAY SUBSTRATE AND DISPLAY APPARATUS

TECHNICAL FIELD

The present disclosure relates to the field of display apparatus technique, and particularly to a pixel driving circuit, an array substrate and a display apparatus.

BACKGROUND

With continual improvements of a scientific and technological level, an Organic Light-Emitting Diode (OLED), as a light-emitting device, has been known more and more by people and has been applied to a display apparatus of high performance widely. The OLED has a wide application prospect because of its advantages such as simple manufacture process, high luminous brightness, quick response speed, low cost, and appropriate operating temperature, etc.

Depending on different driving manners, the OLED may be classified as the Passive Matrix Organic Light-Emitting Diode (PMOLED) and the Active Matrix Organic Light-Emitting Diode (AMOLED). The Passive Matrix driving has a simple process and a low cost, but it requires a shorter driving time for a single pixel with the increasing of the size of a display apparatus thereby the transient current need be increased and the power consumption increases. Also, the increasing of the transient current may lead that the voltage drop on the scan lines and the data lines becomes larger, and the required operating voltage required is raised, resulting in a decrease for the display efficiency. Therefore, many companies focus more attention on the Active Matrix driving manner.

As a common pixel driving circuit structure in the Active Matrix driving manner, as shown in FIG. 1, the pixel driving circuit in the prior art comprises a driving transistor M1, a switch transistor M2, an organic light-emitting diode OLED and a capacitor C1. When the scan voltage is at a high level, the switch transistor M2 is turned on, and the capacitor C1 is charged by a data voltage signal Vdata of the high level. When the scan voltage is at a low level, the switch transistor M2 is turned off, the capacitor C1 is discharged and the driving transistor M1 is kept in a turn-on state. Therefore, the driving transistor M1 is in a saturated turn-on state during a normal operating process. That is, the OLED is in a constant current control process during the whole operating period. The driving current of the light-emitting diode OLED satisfies an equation as follows, according to the calculation equation for the leakage current of the transistor:

$$I_{OLED} = \frac{1}{2}\mu_n \cdot Cox \cdot \frac{W}{L} \cdot (Vgs - Vthn)^2 = \frac{1}{2}\mu_n \cdot Cox \cdot \frac{W}{L} \cdot (Vg - Vs - Vthn)^2,$$

where $\mu_n$ is the carrier mobility, $C_{OX}$ is the value of the insulating film capacitance at the gate per unit area, $$\frac{W}{L}$$

is the width-length ratio of the driving transistor M1, and (Vgs−Vthn) is the over-driving voltage of the driving transistor M1. Herein, Vgs is the voltage difference between the gate and the source of the driving transistor M1, and Vthn is the threshold voltage of the driving transistor M1. Further, Vgs=Vg−Vs=Vdata−(VOLED+ARVSS), Vdata is the data voltage, VOLED is the operating voltage of the OLED, and ARVSS is the common ground terminal voltage. It can be seen that an effect of controlling the constant current for driving the OLED may be achieved by controlling the data voltage Vdata, and since the light-emitting brightness of the OLED is directly proportional to the constant current, the purpose of changing the light-emitting brightness of the OLED may be achieved by controlling the data voltage Vdata.

However, during the development process, the inventors find that the prior arts have at least the following disadvantages: the threshold voltages Vthn of each driving transistor in the pixel driving circuit in the prior art is different because of the process limitations or a shift phenomenon generated under a long time of pressure and a high temperature, resulting in that the over-driving voltage of the respective driving transistors are not consistent, and a non-uniformity of the threshold voltages would finally lead to differences in the display brightness of the display apparatus.

SUMMARY

To solve the above technique problems, the embodiments of the present disclosure provide a pixel driving circuit, an array substrate and a display apparatus, which may eliminate the problem of non-uniformity for threshold voltages and may enhance the display effect for a display apparatus, by compensating for the threshold voltages of driving transistors.

The embodiments of the present disclosure utilize solutions as follows.

In an aspect of the present disclosure, there is provided a pixel driving circuit comprising a driving transistor and an organic light-emitting diode, and the pixel driving circuit further comprises:

a charging compensation module for receiving a data voltage signal, charging the driving transistor and compensating for a threshold voltage of the driving transistor, under the control of a scan voltage signal; and a light-emitting control module for receiving a reference voltage and a power supply voltage, and controlling the organic light-emitting diode to emit lights, under the control of a light-emitting control signal.

Further, the charging compensation module comprises:

a first capacitor, the first terminal thereof is connected with the gate of the driving transistor; and a second transistor, the gate thereof is connected with the scan voltage signal, the source thereof is connected with a second terminal of the first capacitor, and the drain thereof is connected with the data voltage signal.

Further, the light-emitting control module comprises:

a third transistor, the gate thereof is connected with the light-emitting control signal, the source thereof is connected with the drain of the driving transistor, and the drain thereof is connected with the power supply voltage; and a fourth transistor, the gate thereof is connected with the light-emitting control signal, the source thereof is connected with the second terminal of the first capacitor, and the drain thereof is connected with the reference voltage.

In addition, the charging compensation module further comprises:

a fifth transistor, the gate thereof is connected with the scan voltage signal, the source thereof is connected with the gate of the driving transistor, and the drain thereof is connected with the drain of the driving transistor.

Optionally, the transistors are N-type transistors.

In another aspect of the present disclosure, there is further provided an array substrate comprising the pixel driving circuit described above.

In a still further aspect of the present disclosure, there is further provided a display apparatus comprising the array substrate described above.

The embodiments of the present disclosure provide a pixel driving circuit, an array substrate and a display apparatus, which are configured with the charging compensation module and the light-emitting control module and by compensating for the threshold voltages of the driving transistors, the problem of non-uniformity of the threshold voltages is eliminated, the problem of non-uniformity in lights emitted by different pixel units is improved, the driving effect of the pixel driving circuit is enhanced and the display effect of the apparatus is also enhanced.

BRIEF DESCRIPTION OF THE DRAWINGS

In order to explain solutions in embodiments of the present disclosure or the prior art more clearly, drawings required in describing the embodiments of the present disclosure or the prior art will be introduced briefly below. Obviously, the drawings described below are only some embodiments of the present disclosure, and those ordinary skilled in the art may obtain other drawings according to these drawings without any inventive labors.

DETAILED DESCRIPTION

Thereafter, solutions in the embodiments of the present disclosure will be described clearly and completely in connection with drawings. Obviously, the described embodiments are only some, but not all embodiments of the present disclosure. Any other embodiments obtained by those ordinary skilled in the art based on the embodiments of the present disclosure without inventive labors belong to the scope sought for protection by the present disclosure.

Figure 1:
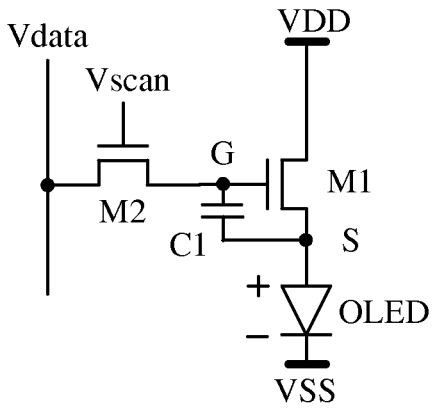
Fig.1 (Prior Art)
FIG. 1 is a circuit diagram illustrating a pixel driving circuit in the prior art.
Figure 2:
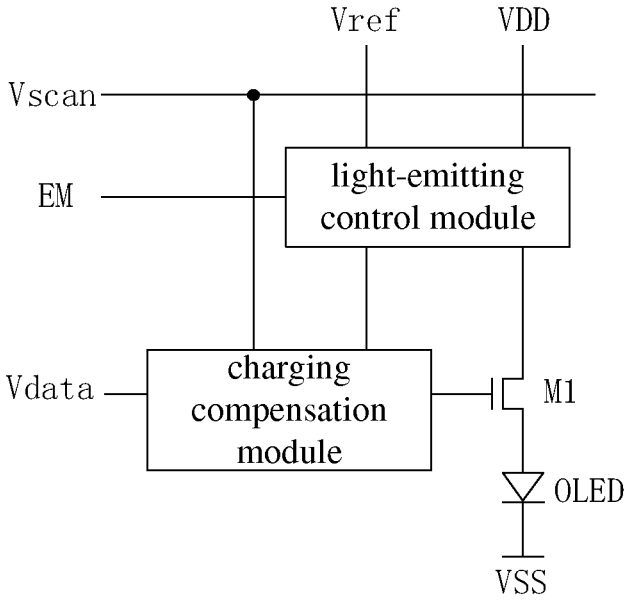
FIG. 2 is a circuit diagram illustrating a pixel driving circuit according to embodiments of the present disclosure.

The embodiments of the present disclosure provide a pixel driving circuit, as illustrated in FIG. 2, comprising a driving transistor M1, an organic light-emitting diode OLED, a charging compensation module and a light-emitting control module, wherein:

the charging compensation module is used for receiving a data voltage signal Vdata, charging the driving transistor M1 and compensating for a threshold voltage of the driving transistor M1, under the control of a scan voltage signal Vscan; and the light-emitting control module is used for receiving a reference voltage Vref and a power supply voltage VDD, and controlling the organic light-emitting diode to emit lights, under the control of a light-emitting control signal EM.

In particular, the charging compensation module comprises a second transistor M2 and a first capacitor C1, and the light-emitting control module comprises a third transistor M3 and a fourth transistor M4.

Figure 3:
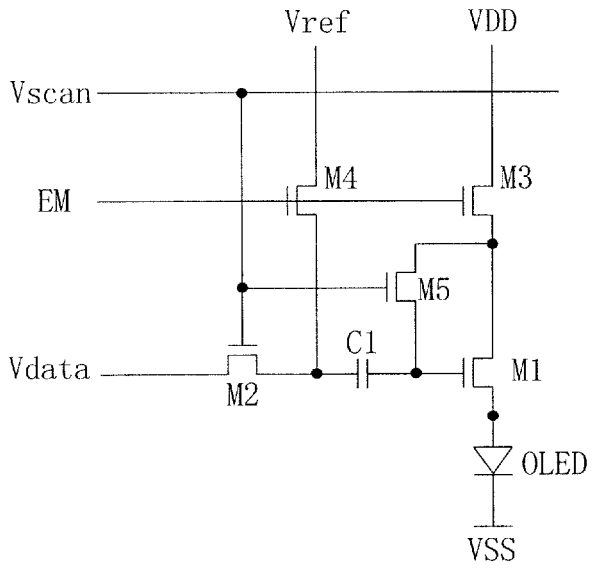
FIG. 3 is a second circuit diagram illustrating the pixel driving circuit according to the embodiments of the present disclosure.

As illustrated in FIG. 3, the driving transistor M1 is used for driving the organic light-emitting diode OLED to emit lights;

the anode of the organic light-emitting diode OLED is connected with the source of the driving transistor M1, and the cathode thereof is connected with a common ground terminal voltage VSS;

the first terminal of the first capacitor C1 is connected with the gate of the driving transistor M1;

the gate of the second transistor M2 is connected with the scan voltage signal Vscan, the source thereof is connected with the second terminal of the first capacitor C1, and the drain thereof is connected with the data voltage signal Vdata;

the gate of the third transistor M3 is connected with the light-emitting control signal EM, the source thereof is connected with the drain of the driving transistor M1, and the drain thereof is connected with the power supply voltage VDD; and the gate of the fourth transistor M4 is connected with the light-emitting control signal EM, the source thereof is connected with the second terminal of the first capacitor C1, and the drain thereof is connected with the reference voltage Vref.

The above driving transistor M1, the second transistor M2, the third transistor M3 and the fourth transistor M4 are all of N-type transistors.

For the convenience of description, the electrode plate corresponding to the first terminal of the first capacitor C1 is referred to as the first electrode plate, and the electrode plate corresponding to the second terminal of the first capacitor C1 is referred to as the second electrode plate thereafter.

Therefore, as illustrated in FIG. 3, when the scan voltage signal Vscan is at a high level and the light-emitting control signal EM is at a low level, the second transistor M2 is turned on, while the third transistor M3 and the fourth transistor M4 are turned off. At this time, the first capacitor C1 receives the data voltage signal Vdata and charges the driving transistor M1 in order to compensate the threshold voltage of the driving transistor M1. When the scan voltage signal Vscan is at the low level and the light-emitting control signal EM is at the high level, the second transistor M2 is turned off, while the third transistor M3 and the fourth transistor M4 are turned on. At this time, the first capacitor C1 receives the reference voltage Vref and charges the driving transistor M1 for the second time, and drives the driving transistor M1 to be turned on, meanwhile the power supply voltage VDD is applied to the light-emitting diode OLED so as to supply a driving current for the light-emitting of the light-emitting diode. It should be noted that the potential difference between the first electrode plate and the second electrode plate in the first capacitor C1 remains unchanged because of the bootstrap effect of the first capacitor C1. Therefore, via the voltage compensation and the driving process of charging for the second time to pull up the voltage, the threshold voltage in an over-driving voltage of the driving transistor M1 is eliminated so that the over-driving voltage is prevented from being affected by the non-uniformity of the threshold voltages.

Furthermore, as illustrated in FIG. 3, the charging compensation module further comprises a fifth transistor M5, the gate thereof is connected with the scan voltage signal Vscan, the source thereof is connected with the first terminal of the first capacitor C 1 and the gate of the driving transistor M1, and the drain thereof is connected with the source of the third transistor M3 and the drain of the driving transistor M1. When the scan voltage signal Vscan is at the high level and the light-emitting control signal EM is at the low level, the fifth transistor M5 is turned on, and connects the gate and the drain of the driving transistor M1, so that the driving transistor M1 operates as a PN junction, and the driving transistor M1 is in a saturated turn-on state.

Thereafter, the pixel driving circuit of the present disclosure would be described in details in connection with the embodiments of the present disclosure. In the following embodiments, the N-type transistor is used as an example for the transistors.

For the convenience of description, thereafter the node corresponding to the gate of the driving transistor M1 is referred to as the node G, the node corresponding to its drain is referred to as the node D, the node corresponding to its source is referred to as a node S, and the node corresponding to the source of the second transistor M2 is referred to as the node A. The electrode plate corresponding to the first terminal of the first capacitor C1 is referred to as the first electrode plate, and the electrode plate corresponding to the second terminal of the first capacitor C1 is referred to as the second electrode plate.

Figure 4:
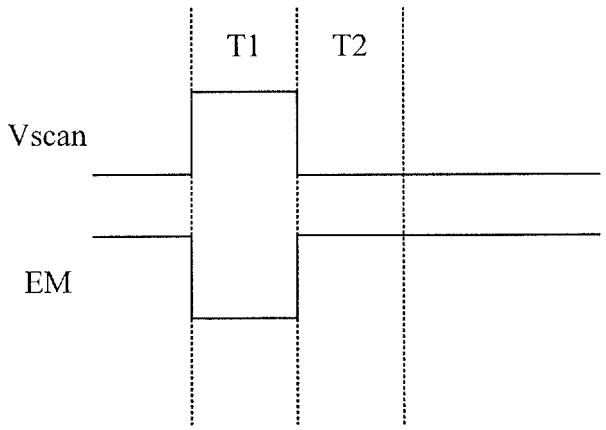
FIG. 4 is an operating timing diagram of the pixel driving circuit according to the embodiments of the present disclosure.

FIG. 4 is an operating timing diagram of the pixel driving circuit according to the embodiments of the present disclosure. The above pixel driving circuit operates under a scan voltage signal Vscan and a light-emitting control signal EM which are input differentially, that is, the scan voltage signal Vscan and the light-emitting control signal EM are input differentially. Therefore, the light-emitting control signal EM is at the low level when the scan voltage signal Vscan is at the high level, and the light-emitting control signal EM is at the high level when the scan voltage signal Vscan is at the low level.

Figure 5:
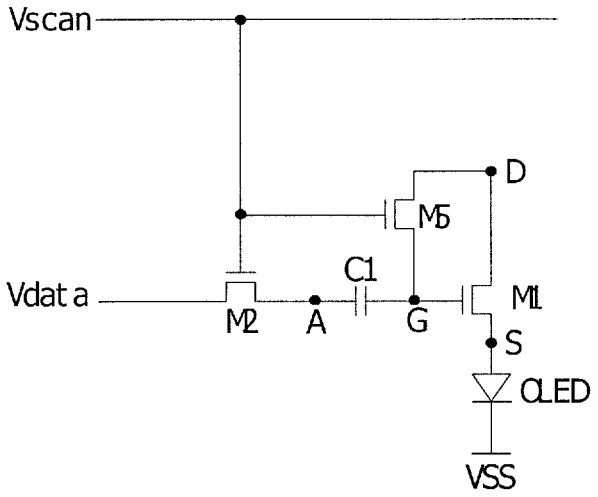
FIG. 5 is an equivalent circuit diagram of the pixel driving circuit according to the embodiments of the present disclosure during a first stage.

As illustrated in FIG. 4, during a first stage T1, the scan voltage signal Vscan is at the high level and the light-emitting control signal EM is at the low level. At this time, an equivalent circuit diagram of the pixel driving circuit of the present embodiment is as shown in FIG. 5, the second transistor M2 and the fifth transistor M5 are turned on, while the third transistor M3 and the fourth transistor M4 are turned off, the data voltage signal Vdata charges the first capacitor C1 for the compensation, and VA=Vdata at this time. Meanwhile, the turning on of the fifth transistor M5 makes the drain and the gate of the driving transistor M1 to be connected with each other, the driving transistor M1 is in the saturated turn-on state at this time, therefore, the threshold voltage of the driving transistor M1 and the voltage difference between the gate and the source satisfies: Vthn=VGS=VG−VS (where, Vthn is the threshold voltage of the driving transistor MD, and the voltage at the node S is VS=VSS+VOLED0, where VSS is the common ground terminal voltage, VOLED0 is the rated operating voltage of the organic light-emitting diode OLED. Therefore, the voltage at the gate of the driving transistor M1 is VG=VS+VGS=VSS+VOLED0+Vthn.

Figure 6:
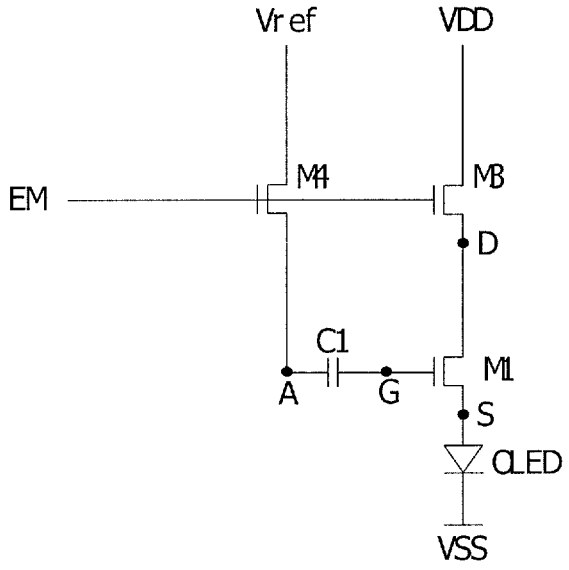
FIG. 6 is an equivalent circuit diagram of the pixel driving circuit according to the embodiments of the present disclosure during a second stage.

During a second stage T2, the scan voltage signal Vscan is at the low level and the light-emitting control signal EM is at the high level. At this time, an equivalent circuit diagram of the pixel driving circuit of the present embodiment is as shown in FIG. 6. The second transistor M2 and the fifth transistor M5 are turned off, while the third transistor M3 and the fourth transistor M4 are turned on, the reference voltage Vref charges the first capacitor C1 for the second time, and VA'=Vref at this time. According to the capacitance equation, C=Q/U, where C is a capacitance value and Q is a quantity of charges carried on the two electrode plates of the capacitor, and U is a voltage difference between the two electrode plates of the capacitor. The quantity of the charges carried on the two electrode plates of the first capacitor C1 remains unchanged after the processes of charging for compensation and the charging for the second time because of the bootstrap effect of the first capacitor C1, therefore the voltage difference between the two electrode plates of the capacitor C1 remains unchanged, and thus the voltage at the node G is pulled up by the processes of charging for compensation and the charging for the second time and at this time, it should satisfy VG'−VA'=VG−VA. Since the driving transistor M1 is in the turn-on state, it may be gained via calculation that at this time, the voltage at the gate of the driving transistor M1 satisfies VG'=Vref+(VSS+VOLED0+Vthn)−Vdata. Further, the voltage at the source of the driving transistor M1 satisfies VS'=VSS+VOLED1, where, VSS is the common ground terminal voltage, and VOLED1 is the operating voltage of the organic light-emitting diode OLED in a normal operating process. It can find that the over-driving voltage applied to the driving transistor M1 during the second stage T2 satisfies $V_{over}$ VG'S'−Vthn=VG'−VS'−Vthn=(Vref+VSS+VOLED0+Vthn−Vdata)−(VSS+VOLED1)−V thn, where Vthn is the threshold voltage of the driving transistor M1. It may be obtained by simplifying that the over-driving voltage applied to the driving transistor M1 during the second stage T2 satisfies $V_{over}$=Vref−Vdata+VOLED0−VOLED1. It can be seen from the above equations that, after the first stage T1 and the second stage T2, in the over-driving voltage applied to the driving transistor M1, the threshold voltage Vthn is no longer included. That is to say, by means of the compensation in the first stage T1, and the driving processes of the charging for compensation and the charging for the second time in the second stage T2, the effect on the over-driving voltage of the driving transistor M1 by the threshold voltage is eliminated, and in turn the over-driving voltages becomes more consistent among different pixel driving circuits, and the problem of the luminous non-uniformity among different pixel units is settled, and the display effect of the display apparatus is finally improved.

Further, it should be particularly noted that during subsequent periods of time, that is, the periods of time following the second stage T2, when the scan voltage signal Vscan remains at the low level and the light-emitting control signal EM remains at the high level, the second transistor M2 and the fifth transistor M5 remain turned off, while the third transistor M3 and the fourth transistor M4 remain turned on at this time, it is referred to the equation for the over-driving voltage of the driving transistor M1 calculated during the second stage T2, wherein $V_{over}$=Vref−Vdata+VOLED0−VOLED1. Thus the light-emitting diode OLED is ensured to always be controlled by the constant current during the subsequent periods.

It can be seen from the above analysis that the first stage T1 and the second stage T2 make up one display frame period of the pixel driving circuit. After the display is completed in the second stage T2, if the scan voltage signal Vscan and the light-emitting control signal EM remain unchanged, the display state of the light-emitting diode OLED would not change. However, when the pixel driving circuit restarts the operating timing as shown in FIG. 4 again, after going through a new display frame period, that is to say, after restarting the signal inputs like those from the first stage T1 to the second stage T2, the new input data voltage signal Vdata may generate a new over-driving voltage, and thus a new light-emitting display frame period for the light-emitting diode is generated and subsequent light-emitting display processes continue.

The embodiments of the present disclosure provide a pixel driving circuit configured with the charging compensation module and the light-emitting control module to eliminate the problem of non-uniformity of the threshold voltages by compensating for the threshold voltages of the driving transistors, and improve the non-uniformity in lights emitted by different pixel units, so that the driving effect of the pixel driving circuit is enhanced and the display effect of the apparatus is enhanced.

Figure 7:
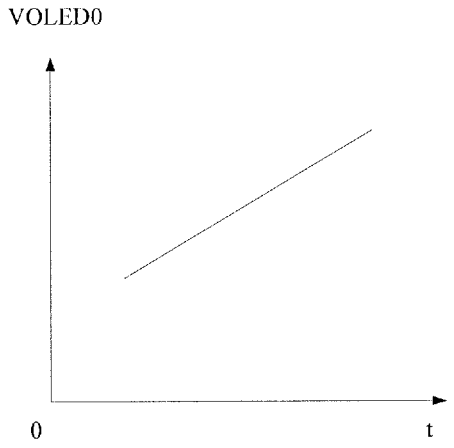
FIG. 7 is a characteristic curve chart illustrating a rated operating voltage of a light-emitting diode OLED.

Furthermore, it should be noted additionally that the pixel driving circuit according to the embodiments of the present disclosure also has characteristics as follows. Taking the pixel driving circuit of the embodiments illustrated in FIG. 3 as an example, the light-emitting diode OLED may age with the usage of the pixel driving circuit, therefore the rated operating voltage required by the light-emitting diode OLED may increase gradually. As illustrated in FIG. 7, its horizontal axis denotes a usage time of the light-emitting diode OLED, and its vertical axis denotes an amplitude of the rated operating voltage VOLED0 of the light-emitting diode. By referring to the calculation process for the over-driving voltage of the driving transistor M1, the over-driving voltage of the driving transistor M1 in the pixel driving circuit satisfies $V_{over}$=Vref−Vdata+VOLED0−VOLED1. Therefore, an increasing of the VOLED0 may lead to an increasing of $V_{over}$, and the increasing of the over-driving voltage may cause an increasing of the driving current of the light-emitting diode and may increase the luminous brightness of the light-emitting diode at last. Therefore, the usage of the pixel driving circuit with the structure according to the embodiments of the present disclosure may exactly make up the adverse effect of display brightness attenuation brought by a long time of usage of the light-emitting diode OLED and extend a display lift span of the light-emitting diode OLED.

In another aspect, the embodiments of the present disclosure provide an array substrate comprising the pixel driving circuit in the embodiments described above. Herein the pixel driving circuit is the same as those described in the above embodiments, so its details are omitted herein. Furthermore, the structures of the other portions in the array substrate may be obtained by referring to the prior art, and their details are omitted herein.

The embodiments of the present disclosure provide an array substrate, the pixel driving circuit thereof is configured with the charging compensation module and the light-emitting control module to eliminate the problem of non-uniformity of the threshold voltages by compensating for the threshold voltages of the driving transistors, and improve the non-uniformity in lights emitted by different pixel units, so that the driving effect of the pixel driving circuit is enhanced and the display effect of the apparatus is enhanced.

In another aspect, the embodiments of the present disclosure provide a display apparatus comprising the array substrate in the embodiments described above. Herein the array substrate is the same as those in the above embodiments, so its details are omitted herein. Further, the structures of the other portions in the display apparatus may be obtained by referring to the prior art, and their details are omitted herein.

The display apparatus according to the embodiments of the present disclosure may be a computer display, a TV display screen, a digital photo frame, a mobile phone, a tablet computer and any other products or parts having the display function, and the present disclosure is not limited thereto.

The embodiments of the present disclosure provide an display apparatus, the pixel driving circuit thereof is configured with the charging compensation module and the light-emitting control module to eliminate the problem of non-uniformity of the threshold voltages by compensating for the threshold voltages of the driving transistors, and improve the non-uniformity in lights emitted by different pixel units, so that the driving effect of the pixel driving circuit is enhanced and the display effect of the apparatus is enhanced.

The above descriptions only illustrate the specific embodiments of the present invention, and the protection scope of the present invention is not limited to this. Given the teaching as disclosed herein, variations or substitutions, which can easily occur to any skilled pertaining to the art, should be covered by the protection scope of the present invention. Thus, the protection scope of the present invention is defined by the claims.

What is claimed is:

1. A pixel driving circuit comprising a driving transistor and an organic light-emitting diode, consisting essentially of:

a charging compensation module for receiving a data voltage signal, charging the driving transistor and compensating for a threshold voltage of the driving transistor, under the control of a scan voltage signal; and a light-emitting control module for receiving a reference voltage and a power supply voltage, and controlling the organic light-emitting diode to emit lights, under the control of a light-emitting control signal, the scan voltage signal and the light-emitting control signal are input differentially; during a first stage, the scan voltage signal is at a high level and the light-emitting control signal is at a low level; and during a second stage, the scan voltage signal is at the low level and the light-emitting control signal is at the high level, the first stage T1 and the second stage T2 make up one display frame period of the pixel driving circuit, wherein the charging compensation module comprises:

a first capacitor, the first terminal thereof is connected with the gate of the driving transistor;

a second transistor, the gate thereof is connected with the scan voltage signal, the source thereof is connected with a second terminal of the first capacitor, and the drain thereof is connected with the data voltage signal; and a fifth transistor, the gate thereof is connected with the scan voltage signal, the source thereof is connected with the gate of the driving transistor, and the drain thereof is connected with the drain of the driving transistor, and the light-emitting control module comprises:

a third transistor, the gate thereof is connected with the light-emitting control signal, the source thereof is connected with the drain of the driving transistor, and the drain thereof is directly connected with the power supply voltage; and a fourth transistor, the gate thereof is connected with the light-emitting control signal, the source thereof is connected with the second terminal of the first capacitor, and the drain thereof is connected with the reference voltage.

2. The pixel driving circuit of claim 1, wherein the driving transistor is a N-type transistors.

3. The pixel driving circuit of claim 1, wherein the driving transistor and the second transistor are N-type transistors.

4. The pixel driving circuit of claim 1, wherein the driving transistor, the second transistor, the third transistor and the fourth transistor are N-type transistors.

5. The pixel driving circuit of claim 1, wherein the driving transistor, the second transistor, the third transistor, the fourth transistor and the fifth transistor are N-type transistors.

6. An array substrate comprising the pixel driving circuit of claim 1.

7. The array substrate of claim 6, wherein the driving transistor, the second transistor, the third transistor, the fourth transistor and the fifth transistor are N-type transistors.

8. A display apparatus comprising the array substrate of claim 6.

* * * * *